US008578537B2

(12) United States Patent
Ley

(10) Patent No.: US 8,578,537 B2
(45) Date of Patent: Nov. 12, 2013

(54) PARTIALLY PREFABRICATED STRUCTURAL CONCRETE BEAM

(76) Inventor: Matthew Ley, Austin, TX (US)

( * ) Notice: Subject to any disclaimer, the term of this patent is extended or adjusted under 35 U.S.C. 154(b) by 1502 days.

(21) Appl. No.: 11/306,507

(22) Filed: Dec. 30, 2005

(65) Prior Publication Data

US 2007/0175166 A1 Aug. 2, 2007

(51) Int. Cl.
*E04B 1/20* (2006.01)
*E04C 3/20* (2006.01)

(52) U.S. Cl.
USPC ..... 14/74.5; 52/252

(58) Field of Classification Search
USPC ..... 52/251, 252, 258; 14/74.5
See application file for complete search history.

(56) References Cited

U.S. PATENT DOCUMENTS 2,435,998 A * 2/1948 Cueni ..... 52/223.8
2,783,638 A * 3/1957 Henderson ..... 52/252
3,557,504 A * 1/1971 Lipski ..... 52/179
3,999,735 A 12/1976 Brownlee
4,363,200 A * 12/1982 Goldenberg ..... 52/251
4,443,985 A 4/1984 Moreno
4,977,636 A * 12/1990 King ..... 14/73
5,425,152 A 6/1995 Teron
5,655,243 A 8/1997 Kim
6,293,063 B2 * 9/2001 Van Doren ..... 52/251
6,470,524 B1 10/2002 Mairantz
6,568,139 B2 5/2003 Bot
6,578,343 B1 6/2003 Dumler et al.

OTHER PUBLICATIONS

Freeby, Gregg; Medlock, Ronald; Slagle, Sharon, Prefabricated Bridge Innovations, Texas Department of Transportation, Oct. 2003.
Freeby, Greg; Hyzak, Michael; Medlock, Ronald D.; Ozuna, Kenneth; Vogel, John; Wolf, Lloyd M.; Design and Construction of Precast Bent Caps at TXDOT; Texas Department of Transportation, Jul. 23, 2002.

* cited by examiner

*Primary Examiner* — Michael Safavi
(74) *Attorney, Agent, or Firm* — George M. Tompkins; Tompkins, P.C.

(57) ABSTRACT

A structural concrete beam, and method therefor, comprising a prefabricated structural concrete portion and a poured-in-place structural concrete portion, wherein said poured-in-place portion comprises at least ten percent of the total weight of said structural concrete beam. Reinforcing extends from the prefabricated portion to the poured-in-place portion. In a preferred embodiment, the structural concrete beam is an "inverted-T" beam, and the prefabricated structural concrete portion comprises the lower corbel portion of the beam, and the poured-in-place structural concrete portion comprises the remaining upper stem portion of the beam.

7 Claims, 3 Drawing Sheets

PARTIALLY PREFABRICATED STRUCTURAL CONCRETE BEAM

BACKGROUND OF THE INVENTION

1. Field of the Invention

This invention relates to a partially prefabricated structural concrete beam and method therefor.

2. Description of Related Art

Structural concrete includes prestressed concrete, post-tensioned concrete, reinforced concrete, and plain concrete, among others. The use of prefabricated structural concrete elements in bridge and building construction is an accepted means for achieving certain advantages. For example, use of such elements may speed construction and/or lower overall costs. It may also be safer for workers to erect a prefabricated concrete element as compared to pouring a similar concrete element in-place.

Commonly, a plurality of flat prefabricated concrete panels are utilized to construct the deck portion of a roadway bridge; these panels typically span between longitudinal support members and are most often topped with a depth of concrete which ties the structure together and completes the roadway surface. Prefabricated concrete members are also commonly utilized in bridge construction to span across or between support columns, or to span longitudinally in support of the deck. Such prefabricated members commonly are designed such that small sections of less than ten percent of the total weight of the member are poured-in-place in the field in order to complete the needed connections between the prefabricated member and other elements of the structure, such as columns or walls. The use of such large prefabricated concrete members, therefore, is of significantly reduced benefit due to their sheer size, weight, and handling difficulties.

The known prior art methods of bridge construction do not integrate, in a single beam member, prefabricated structural concrete with poured-in-place structural concrete in the manner of the present invention. In view of the prior art, a method of beam construction is needed by which a single structural concrete beam, such as an "inverted-T" bent cap, for example, beneficially utilizes both prefabricated structural concrete and poured-in-place structural concrete along a significant portion of the length of the beam.

BRIEF SUMMARY OF THE INVENTION

In view of the known prior art structural concrete members and methods, the present invention provides a partially prefabricated structural concrete beam comprising a prefabricated structural concrete portion. The structural concrete beam of the present invention further comprises a poured-in-place structural concrete portion along a significant portion of the length of the beam. In relation to the prior art, the structural concrete beam of the present invention thus reduces the effort necessary for erecting the prefabricated portion and/or effectively reduces the overall size and weight of the prefabricated portion. Other benefits of the present invention include acceleration of the expected schedule of construction, reduction in the amount of reinforcement necessarily placed by workers on-site, and/or reduction in the amount and complexity of necessary formwork. The poured-in-place portion of the present invention is not simply an incidental feature necessarily resulting from connectivity or the like; rather, it is a novel and important aspect of the overall design of the inventive beam itself. These objects are not exhaustive, and are not intended to limit the scope of the invention disclosed and claimed herein. Many other applications, benefits, and advantages of the present invention will be appreciated by those of skill in the art. A further understanding of the present invention may be had by referring to the following Detailed Description of the Preferred Embodiment.

BRIEF DESCRIPTION OF THE DRAWINGS

Various preferred embodiments of the current invention are further described and explained in relation to the following figures wherein.

DETAILED DESCRIPTION OF THE PREFERRED EMBODIMENT

The preferred and alternative embodiments of the present invention are described and illustrated herein with respect to their primary use in roadway bridge construction. It is understood, however, that the present invention is not limited to use with such structures, and may be adapted for use with other types of structures as well, such as office or residential buildings, or parking garages. It is further understood that the cross-sectional shape of the inventive member as presented herein is not limited to that of an "inverted-T", and can be embodied in any alternative cross-section in accordance with the appended claims. Those of skill in the art will recognize a multitude of uses for, and equivalent variations of, the present invention, and those enumerated specifically herein are illustrative only, and do not limit the scope of the present invention.

Figure 2:
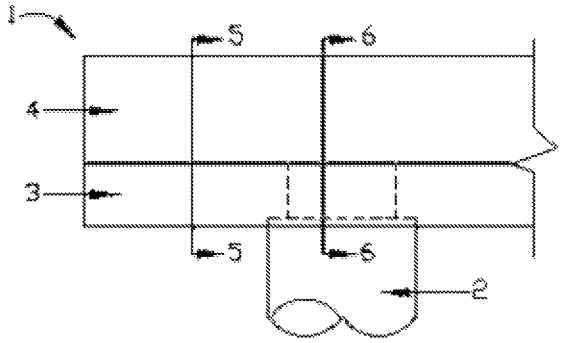
FIG. 2 is a partial side elevation view of a preferred embodiment of a structural concrete support beam in accordance with the present invention.
Figure 5:
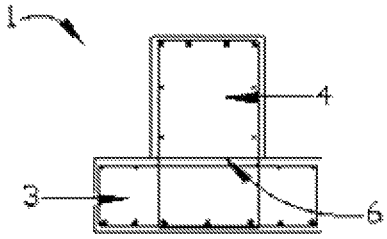
FIG. 5 is a typical cross-sectional view of the structural concrete support beam of FIG. 2.
Figure 6:
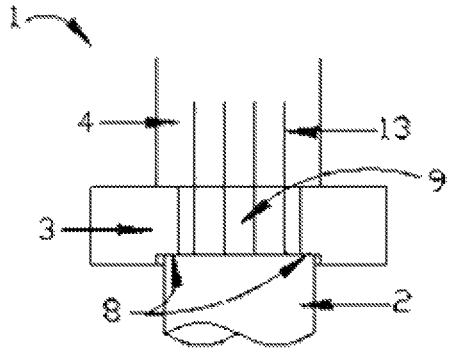
FIG. 6 is a preferred cross-sectional view of the structural concrete support beam of FIG. 2 at a support location.

Referring now to FIG. 2, a partial elevation view of a preferred embodiment of a completed partially prefabricated bridge structural concrete beam in accordance with the present invention is shown. Structural concrete beam 1 is preferably an "inverted-T" beam, as shown more clearly in FIGS. 5 and 6. Beam 1 is preferably supported at an elevation atop a number of columns 2. Columns 2 can be of any desired shape and material, such as a round reinforced concrete cross-section. Beam 1 comprises a prefabricated concrete portion 3 and a conventional poured-in-place concrete portion 4. Preferably, prefabricated concrete portion 3 generally comprises the lowermost section of beam 1, and the poured-in-place portion 4 generally comprises the uppermost remaining section of beam 1, as illustrated in FIGS. 5 and 6.

Prefabricated concrete portion 3 of beam 1 is preferably constructed at on off-site facility utilizing any precasting or prefabrication method as are widely known in the art, or as may be later developed. Prefabricated portion 3 is then shipped to the final construction site and erected into place as illustrated, for example, in FIG. 1, using a crane or other appropriate means. Prefabricated portion 3 comprises reinforcing 5 and concrete. The exact amount and placement of reinforcing 5 will, of course, vary according to the circumstances and requirements of any given application. The selection and design of the reinforcing 5 is left to the discretion of the designer, and is within the ordinary skill of structural engineers or others in the art. Reinforcing 5 may be of any type, including but not limited to conventional steel reinforcing, fiberglass, prestressing strands, and/or post-tensioning strands. Reinforcing 5 includes all reinforcing of structural member 1, whether placed as an integral part of prefabricated portion 3 or as part of poured-in-place portion 4. Likewise, the selection and specification of the concrete for prefabricated portion 3 is left to the discretion of the designer, and is within the ordinary skill of structural engineers or others in the art. Because only a portion of the complete structural concrete beam 1 is prefabricated, a portion of the reinforcing 5 preferably extends beyond the concrete limit of the prefabricated portion, as illustrated best in FIGS. 1 and 7. The extended portion of reinforcing 5 is therefore exposed until the poured-in-place portion 4 of structural concrete beam 1 is placed. In the case of the illustrated preferred embodiment at FIGS. 1 and 7, the upper section of the stem reinforcing is so exposed.

Figure 1:
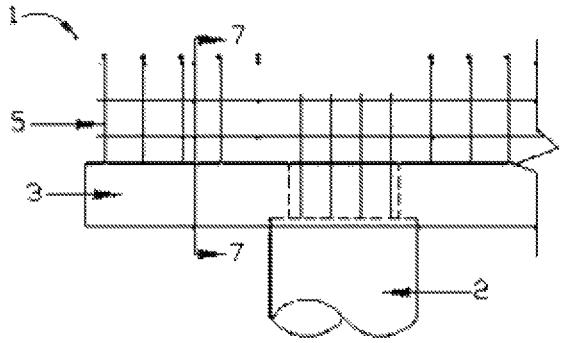
FIG. 1 is a partial side elevation view of the prefabricated concrete portion of an embodiment of a structural concrete support beam in accordance with the present invention.
Figure 7:
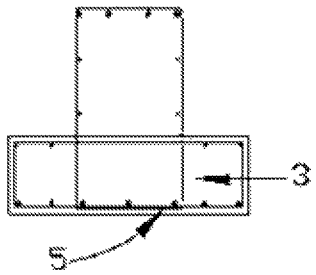
FIG. 7 is a cross-sectional view of the prefabricated concrete portion of FIG. 1, illustrating a preferred arrangement of reinforcing extending beyond the concrete limit of said prefabricated concrete portion.

Following shipment and erection of prefabricated concrete portion 3, poured-in-place concrete portion 4 is constructed. The poured-in-place concrete portion 4, in accordance with the present invention, includes all non-prefabricated concrete portions of structural concrete member 1 which are placed on-site. Preferably, all reinforcing 5 necessary or desired for poured-in-place portion 4 is already present, having been provided as a quantity of reinforcing extending beyond the concrete limit of the prefabricated portion 3 as previously described and as illustrated in FIGS. 1 and 7. Alternatively, the remaining quantity of reinforcing necessary or desired for poured-in-place portion 4 is set on-site prior to placement of the concrete for poured-in-place portion 4.

Figure 8:
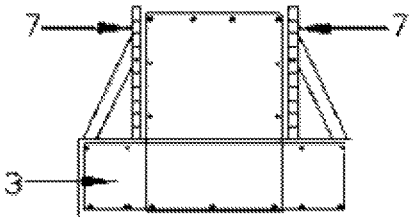
FIG. 8 is a cross-sectional view of the prefabricated concrete portion of a structural concrete support beam in accordance with the present invention, more particularly illustrating a preferred arrangement of formwork for constructing the poured-in-place concrete portion of said structural concrete support beam.

Poured-in-place concrete portion 4 is constructed utilizing any of the widely known methods in the art. Wood formwork, for example, may be erected as illustrated generally in FIG. 8. The formwork may alternatively be comprised of any suitable material, such as steel or plastic, and may further be of multi-use or single-use construction. In any event, formwork 7 is constructed such that the concrete placement of poured-in-place portion 4 may be completed. In the case of the preferred embodiment illustrated in FIG. 8, workers are able to utilize the top surface of prefabricated concrete portion 3 as a work platform while erecting formwork 7 and ultimately placing the fresh concrete necessary for the completion of poured-in-place portion 4. At an appropriate time following placement of the fresh concrete of poured-in-place portion 4, i.e., after the concrete has sufficiently gained strength or cured, formwork 7 may be removed and the remainder of the overall greater structure may be constructed as desired. Of course, the selection and specification of the concrete for poured-in-place portion 4 is left to the discretion of the designer, and is within the ordinary skill of structural engineers or others in the art. The placement of poured-in-place portion 4 results in the creation of a cold joint 6 between prefabricated portion 3 and poured-in-place portion 4.

As described and illustrated, partially prefabricated structural concrete beam 1 is preferably a multi-span bent having an "inverted-T" cross-section for a roadway bridge. As illustrated in FIG. 2, such applications necessarily involve bearing of the structural beam 1 on support columns 2. Those of skill in the art will appreciate that there are numerous acceptable means for connecting or otherwise supporting structural beam 1 on columns 2. Of course, structural concrete beam 1 may also be supported atop a wall, embankment, or the like, without detracting from the present invention.

Figure 3:
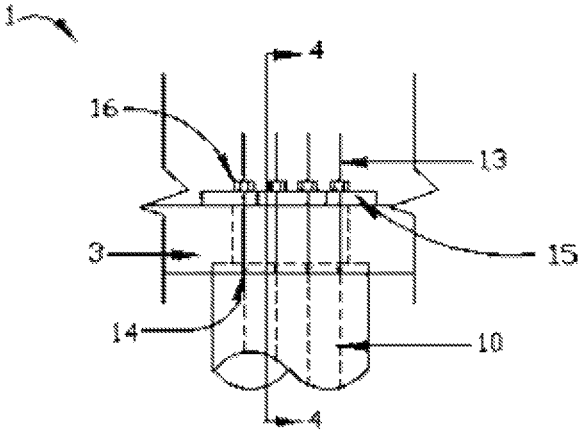
FIG. 3 is a partial side elevation view of the prefabricated concrete portion of an embodiment of a structural concrete support beam in accordance with the present invention, more particularly illustrating a preferred embodiment of a connection between the prefabricated concrete portion and a column.
Figure 3A:
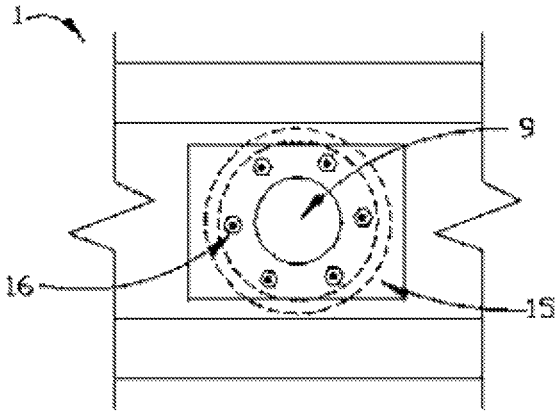
FIG. 3A is a partial plan view of the connection of FIG. 3.
Figure 4:
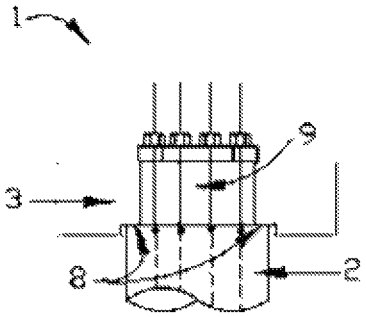
FIG. 4 is a cross-sectional view of the connection of FIG. 3.

Preferably, prefabricated portion 3 is connected to columns 2 prior to the forming-up and placement of poured-in-place portion 4. This intermediate connection improves safety and reduces the likelihood that prefabricated portion 3 will become dislodged or otherwise fall from its location atop columns 2. One alternative method of intermediately connecting prefabricated portion 3 to column 2 is illustrated in FIGS. 3, 3A, and 4. It is noted that in each of FIGS. 3, 3A, and 4, reinforcing 5 is not shown for clarity. In this embodiment, prefabricated portion 3 includes a recessed bearing area 8 and void 9. Void 9 is dimensioned so as to allow for the placement of threaded bars 13 into bar couplers 14. Bar couplers 14 allow for the splicing of threaded bars 13 with the longitudinal reinforcing 10 of column 2. Plate 15 is also provided, and includes a set of holes through which bars 13 are placed. Plate 15 is dimensioned such that it extends beyond the limits of void 9. Nuts 16 are placed onto the threaded ends of bars 13 and tightened against plate 15. Plate 15 further includes a hole or other means by which concrete may flow into void 9 upon placement of the poured-in-place portion 3 of beam 1. Alternatively, longitudinal reinforcing 10 may extend beyond the limit of the concrete portion of column 2 and receive nuts 16.

Recessed bearing area 8 and void 9 are illustrated again in FIG. 6. It is noted that in FIG. 6, reinforcing 5 is not shown for clarity. It is further noted that the intermediate connections of FIGS. 3 and 3A are omitted from FIG. 6 for clarity. Void 9 is formed in prefabricated concrete portion 3. Void 9 is dimensioned so as to receive threaded bars 13, and also to provide a bearing area to insure load transfer during construction.

Figure 11:
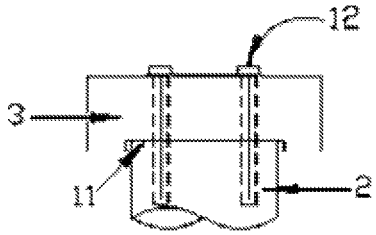
FIG. 11 is a cross-sectional view of the prefabricated concrete portion of a structural concrete support beam in accordance with the present invention, more particularly illustrating an embodiment for connecting said prefabricated concrete portion to a support column.

By way of alternative example, structural concrete beam 1 may include a recessed bearing area 11 as illustrated in FIG. 11. It is noted that reinforcing 5 is omitted from FIG. 11 for clarity. In this embodiment, a connection between column 2 and structural concrete beam 1 is formed by placing headed steel reinforcing bars 12 into holes and setting them in place with epoxy. Bars 12 extend through prefabricated concrete portion 3 and into column 2.

Numerous alternatives will be apparent to those of skill in the art, and any such means of connecting or otherwise supporting structural concrete beam 1 on columns 2 may be utilized without detracting from the present invention. Such alternatives may include, without limitation: field welded steel connections, threaded bars with plates, guy wires, welded rebar, and gravity.

Those of skill in the art will further appreciate that the practice of prefabricating only a portion of the structural concrete support beam 1 in accordance with the present invention will require slight modifications to the traditional or common reinforcing placement as utilized in either completely prefabricated members or completely poured-in-place members of like cross-section. For example, in the case of the "inverted-T" section as discussed and illustrated herein, some additional reinforcing may be required in the upper portion of the corbel in order to take the load produced by the placement of the fresh concrete of the poured-in-place portion, as well as the negative moment produced by the self-weight and handling of the prefabricated portion itself.

Figure 9:
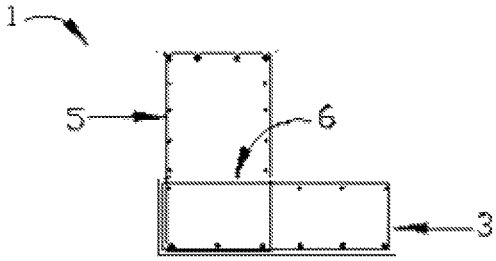
FIG. 9 is a cross-sectional view of an embodiment of a structural concrete support beam in accordance with the present invention, wherein said support beam is an "L" shaped beam.
Figure 10:
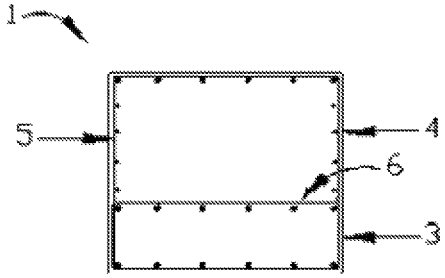
FIG. 10 is a cross-sectional view of an embodiment of a structural concrete support beam in accordance with the present invention, wherein said support beam is a rectangular beam.

Having thus described the present invention in terms of several alternative and preferred embodiments, it is recognized that those of skill in the art will appreciate the several advantages inherent in the present invention over the prior art. It is further recognized that those of skill in the art will appreciate the various geometric configurations which may be employed in designing structural concrete beams in accordance with the present invention without limitation. By way of example, a partially prefabricated structural concrete support beam according to the present invention may be constructed having an "L" shaped cross-section, as illustrated in FIG. 9. By way of further example, a partially prefabricated structural concrete support beam according to the present invention may be constructed having a rectangular cross-section, as illustrated in FIG. 10. In each of FIGS. 9 and 10, like numerals represent like elements, as each respective cross-section represents a structural concrete support beam 1 having a prefabricated concrete portion 3, a poured-in-place concrete portion 4, reinforcing 5, and cold joint 6. It will be further appreciated by those of skill in the art that the benefits of the present invention may be utilized in a number of environments other than roadway bridge construction. All embodiments falling within the scope of the appended claims are therefore considered part of the present invention, as are equivalents thereof.

What is claimed is:

1. A structural concrete beam, comprising:

a lowermost-prefabricated structural concrete portion having an uppermost point and a lowermost point;

an uppermost poured-in-place structural concrete portion, wherein said poured-in-place structural concrete portion comprises at least ten percent of the total weight of said structural concrete beam;

wherein said uppermost poured-in-place structural concrete portion extends substantially above said uppermost point of said lowermost prefabricated structural concrete portion;

wherein said uppermost poured-in-place portion is constructed utilizing temporary formwork;

wherein said lowermost prefabricated structural concrete portion is sufficiently strong to support the moment load produced by the placement of fresh concrete of the poured-in-place portion and the self-weight of the prefabricated portion itself;

reinforcing extending from said lowermost prefabricated structural concrete portion into said uppermost poured-in-place structural concrete portion; said structural concrete beam is an inverted-T beam and wherein said prefabricated structural concrete portion forms the horizontal corbel of said inverted-T beam and said poured-in-place portion forms the vertical web portion of said inverted-T beam.

2. A structural concrete beam, comprising:

a prefabricated structural concrete portion;

a poured-in-place structural concrete portion, wherein said poured-in-place portion comprises at least ten percent of the total weight of said structural concrete beam;

wherein said poured-in-place structural concrete portion is constructed utilizing temporary formwork and wherein the prefabricated structural concrete portion is sufficiently strong to support the moment load produced by the placement of fresh concrete of the poured-in-place portion and the self-weight of the prefabricated portion itself;

reinforcing extending from said prefabricated structural concrete portion into said poured-in-place structural concrete portion; and wherein said structural concrete beam is an "inverted-T" beam.

3. A structural concrete beam according to claim 2, wherein: said structural concrete beam is connected to a support column.

4. A structural concrete beam according to claim 3, further comprising:

a recessed bearing area in said prefabricated portion for receiving an uppermost first end of said support column; and a void in said prefabricated portion for receiving reinforcing which extends from said uppermost first end of said support column.

5. A structural concrete beam according to claim 2, wherein: said poured-in-place portion comprises at least twenty percent of the total weight of said structural concrete beam.

6. A structural concrete beam according to claim 2, wherein: said poured-in-place portion comprises at least thirty percent of the total weight of said structural concrete beam.

7. A structural concrete beam according to claim 2, wherein: said poured-in-place portion comprises at least forty percent of the total weight of said structural concrete beam.

* * * * *